US008194057B2

(12) United States Patent
Lee et al.

(10) Patent No.: US 8,194,057 B2
(45) Date of Patent: Jun. 5, 2012

(54) DISPLAY APPARATUS

(75) Inventors: Hong-Woo Lee, Cheonan-si (KR); Myung-Koo Hur, Cheonan-si (KR); Jong-Hwan Lee, Anyang-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 1329 days.

(21) Appl. No.: 11/782,967

(22) Filed: Jul. 25, 2007

(65) Prior Publication Data

US 2008/0068358 A1 Mar. 20, 2008

(30) Foreign Application Priority Data

Sep. 18, 2006 (KR) ..... 10-2006-0090255

(51) Int. Cl.
*G09G 5/00* (2006.01)

(52) U.S. Cl. ..... 345/204; 345/92

(58) Field of Classification Search ..... 345/90, 345/204, 76, 92, 100, 55; 347/238
See application file for complete search history.

(56) References Cited

U.S. PATENT DOCUMENTS

| | | | | |
|---|---|---|---|---|
| 7,907,113 | B2 * | 3/2011 | Jang et al. | 345/100 |
| 2002/0047822 | A1 * | 4/2002 | Senda et al. | 345/90 |
| 2002/0196208 | A1 * | 12/2002 | Nanno et al. | 345/55 |
| 2004/0257322 | A1 | 12/2004 | Moon | |
| 2005/0116914 | A1 * | 6/2005 | Nagao et al. | 345/92 |
| 2006/0061535 | A1 | 3/2006 | Kim et al. | |
| 2006/0071890 | A1 | 4/2006 | Kikuchi | |
| 2006/0164352 | A1 | 7/2006 | Yoo | |

FOREIGN PATENT DOCUMENTS

| | | |
|---|---|---|
| EP | 1492078 A2 | 12/2004 |
| JP | 2001-051252 | 2/2001 |
| JP | 2005-018066 | 1/2005 |
| JP | 2005-055813 | 3/2005 |
| JP | 2006-106394 | 4/2006 |
| JP | 2006-139288 | 6/2006 |
| JP | 2006-215572 | 8/2006 |
| JP | 2007-025698 | 2/2007 |
| KR | 10-2005-0000105 | 1/2005 |
| KR | 1020060027593 | 3/2006 |
| KR | 10-2006-0052038 | 5/2006 |
| WO | 2007/091365 | 8/2007 |

OTHER PUBLICATIONS

European Search Report dated Sep. 9, 2009.

* cited by examiner

*Primary Examiner* — Quan-Zhen Wang
*Assistant Examiner* — Yuk Chow
(74) *Attorney, Agent, or Firm* — H.C. Park & Associates, PLC

(57) ABSTRACT

A display apparatus has a pixel including a main pixel connected to a main gate line and a data line, and a sub-pixel connected to a sub-gate line and the data line. A main gate driver outputs a main gate pulse to the main gate line during a time period 1H. A sub-gate driver receives the main gate pulse and outputs a sub-gate pulse to the sub-gate line during a first portion of time period 1H. The data driver applies a sub-pixel voltage to the data line during the first portion of time period 1H and applies the main pixel voltage to the data line during a second portion of time period 1H.

21 Claims, 6 Drawing Sheets

DISPLAY APPARATUS

CROSS REFERENCE TO RELATED APPLICATION

This application claims the benefit of and priority to Korean Patent Application No. 2006-90255 filed on Sep. 18, 2006, which is hereby incorporated by reference for all purposes as if fully set forth herein.

BACKGROUND OF THE INVENTION

1. Field of the Invention

The present invention relates to a display apparatus, and more specifically to a Liquid Crystal Display (LCD) apparatus having main gate drivers for driving main pixels and sub-gate drivers for driving sub-pixels.

2. Discussion of the Background

In general, an LCD apparatus may include an LCD panel including a bottom substrate, a top substrate facing the bottom substrate and a liquid crystal layer interposed between the bottom substrate and the top substrate. The LCD panel may also include gate lines, data lines and pixels connected to the gate lines and the data lines. Signals are supplied to the gate lines and data lines to apply an electric field across the liquid crystal layer. Since the liquid crystals in the liquid crystal layer may have an anisotropic dielectric constant, the alignment of the liquid crystals may change when the electric field is applied across the liquid crystal layer. In addition, since the liquid crystals have an anisotropic refractive index, light transmittance of the LCD apparatus may vary according to the alignment of the liquid crystals. The LCD apparatus applies an electric field between the two substrates such that the liquid crystals have a light transmittance corresponding to display information transmitted as data signals. Thus, the alignment of the liquid crystals may vary according to the applied electric field.

Further, the alignment of the liquid crystals may control the transmission of backlight illumination through the liquid crystal layer to display images on the LCD apparatus.

The LCD apparatus may include a gate driver for sequentially outputting a gate pulse to the gate lines and a data driver for outputting a data voltage to the data lines. The gate driver and the data driver may each be arranged as a chip on a film of the LCD panel.

Recently, in order to reduce the number of chips, an LCD apparatus may employ a gate-IC-less (GIL) structure in which the gate driver is arranged directly on the bottom substrate by a thin film forming process. In the LCD apparatus with the GIL structure, the gate driver may include a shift register having multiple stages connected in series to provide gate pulses to the gate lines.

In addition, patterned vertical alignment (PVA) mode LCD apparatuses, multi-domain vertical alignment (MVA) mode LCD apparatuses, and super-patterned vertical alignment (S-PVA) mode LCD apparatuses have been developed in order to improve the viewing angle of LCD apparatuses.

For example, an S-PVA mode LCD apparatus may have a pixel including two sub-pixels, in which each sub-pixel has a main pixel electrode and a sub-pixel electrode and different sub-voltages are applied to the main pixel electrode and the sub-pixel electrode in order to form domains having different grays. Since an observer viewing an image displayed on the LCD apparatus may recognize an intermediate value between the main voltage and the different sub-voltage, the lateral viewing angle of the LCD apparatus may not be narrowed by the distortion of a gamma curve at the intermediate gray level, so that the lateral visibility of the LCD apparatus may be improved.

The S-PVA mode LCD apparatuses may be classified as a coupling capacitor (CC) type LCD apparatus or a two transistor (TT) type LCD apparatus according to the driving scheme thereof.

A CC type LCD apparatus may further include a coupling capacitor between the main pixel electrode and the sub-pixel electrode. The main voltage applied to the main pixel electrode may be modified by a stored voltage in the capacitor. Therefore, the main voltage applied to the main pixel electrode may be different from the sub-voltage applied to the sub-pixel electrode.

A TT type LCD apparatus may employ two transistors that are turned on sequentially with a predetermined time interval to apply main voltages to the main electrodes and sub-pixel voltages to the sub-pixel electrodes, where the main voltages and the sub-pixel voltages have different voltage levels. However, the driving frequency for the TT type LCD apparatus may be increased in order to drive the two transistors. The increase in driving frequency may increase the power consumption of the TT type LCD apparatus.

Further, in the TT type S-PVA mode LCD apparatus having the GIL structure, the number of stages of the gate driver may increase since twice the number of transistors may be driven. The additional stages in the gate driver may increase the size of the LCD panel, which also may increase power consumption of the LCD apparatus.

SUMMARY OF THE INVENTION

This invention provides a LCD apparatus capable of minimizing the size thereof while saving power consumption by reducing the driving frequency.

Additional features of the invention will be set forth in the description which follows, and in part will be apparent from the description, or may be learned by practice of the invention.

This invention provides a display apparatus including a first substrate including a main gate line, a sub-gate line, a data line, and a pixel, the pixel including a main pixel connected to the main gate line and the data line and a sub-pixel connected to the sub-gate line and the data line, a second substrate coupled with the first substrate and facing the first substrate, a main gate driver to apply a first main gate pulse to the main gate line for a first period, a sub-gate driver to apply a sub-gate pulse to the sub-gate line during a second period, wherein the second period comprises a portion of the first period, and a data driver to apply a sub-pixel voltage to the data line during the second period, and to apply a main pixel voltage to the data line during a third period comprising a portion of the first period that is separate from the second period.

This invention also provides a liquid crystal display apparatus including a first substrate, a second substrate facing the first substrate, a pixel having a main pixel and a sub-pixel, a main gate driver to output a main gate pulse to the main pixel, and a sub-gate driver to output a sub-gate pulse to the sub-pixel in response to the main gate pulse.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
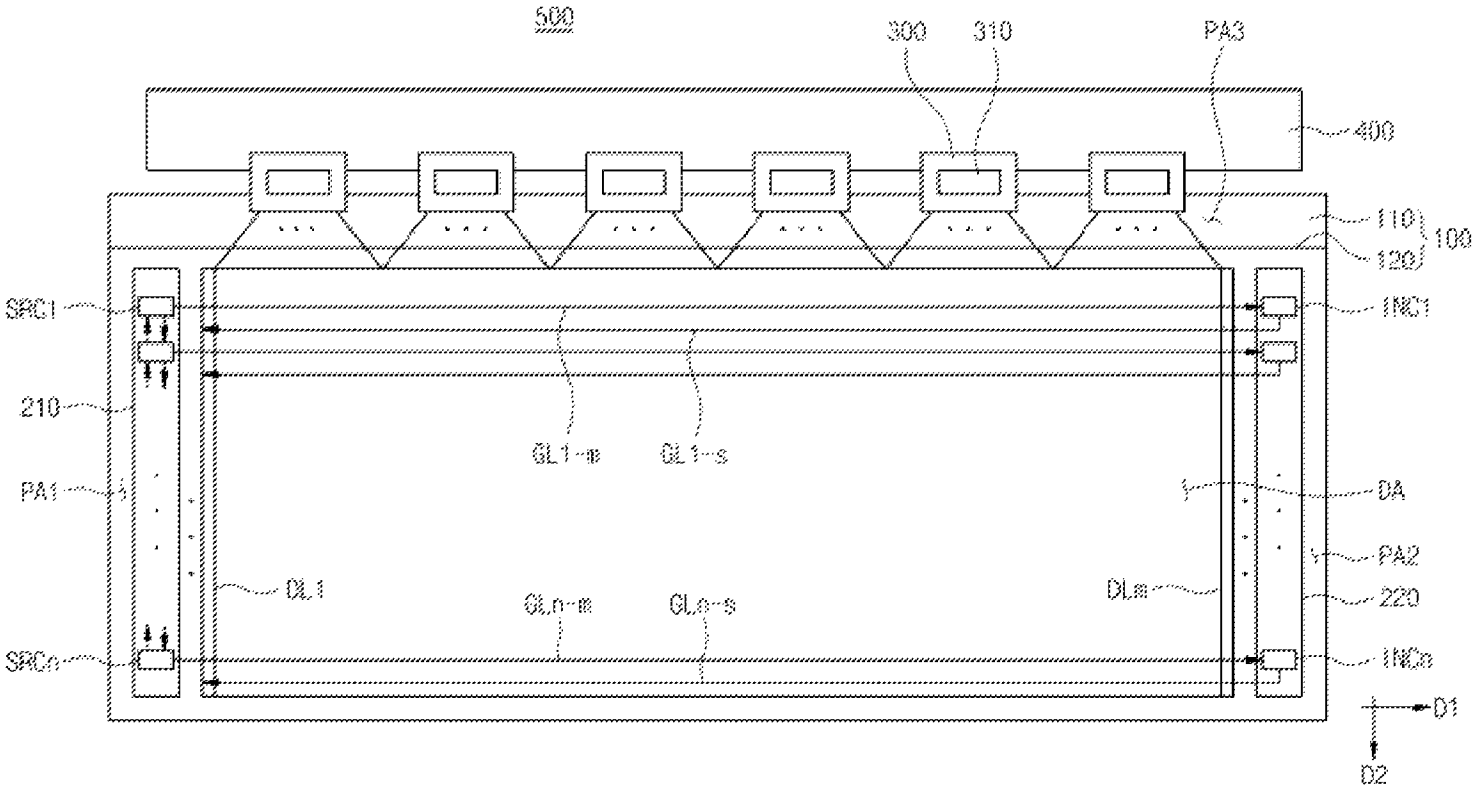
FIG. 1 shows a plan view of an LCD apparatus according to an exemplary embodiment of the present invention.

The invention is described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure is thorough, and will fully convey the scope of the invention to those skilled in the art. In the drawings, the size and relative sizes of layers and regions may be exaggerated for clarity. Like reference numerals in the drawings denote like elements.

It will be understood that when an element or layer is referred to as being "on" or "connected to" another element or layer, it can be directly on or directly connected to the other element or layer, or intervening elements or layers may be present. In contrast, only when an element is referred to as being "directly on" or "directly connected to" another element or layer are there are no intervening elements or layers present.

It will also be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

FIG. 1 shows a plan view of an LCD apparatus according to an exemplary embodiment of the present invention. The LCD apparatus 500 shown in FIG. 1 may be an S-PVA LCD apparatus having a pixel including a main pixel and a sub-pixel.

Referring to FIG. 1, the S-PVA LCD apparatus 500 may include a LCD panel 100 for displaying images, a printed circuit board 400 arranged proximate to the LCD panel 100, and a tape carrier package 300 connecting the LCD panel 100 to the printed circuit board 400.

The LCD panel 100 may include an array substrate 110, a color filter substrate 120 facing the array substrate 110, and a liquid crystal layer (not shown) interposed between the array substrate 110 and the color filter substrate 120. The array substrate 110 may be divided into a display area DA for displaying images and a first peripheral area PA1, a second peripheral area PA2, and a third peripheral area PA3 arranged adjacent to the display area DA.

Pixels may be arranged in a matrix in the display area DA of the array substrate 110. The display area DA may also include main gate lines GL1-*m* to GLn-m (where n is an integer equal to or greater than 1) extending in a first direction D1, sub-gate lines GL1-*s* to GLn-s also extending in the first direction D1, and data lines DL1 to DLm (where m is an integer equal to or greater than 1) extending in a second direction D2 substantially perpendicular to the first direction D1. The pixels may be arranged in pixel areas defined by the gate lines and data lines. Each pixel may include a main pixel and a sub-pixel. A main pixel may be connected to a corresponding main gate line and a data line. A sub-pixel may be connected to a corresponding sub-gate line and the data line.

Color pixels such as red, green, and blue color pixels, including red, green, and blue color filters to filter red, green, and blue light respectively, may be arranged on the color filter substrate 120 corresponding to the pixel areas.

The first peripheral area PA1 may be arranged proximate to first ends of the main gate lines GL1-*m* to GLn-m, and may include a main gate driver 210 that sequentially applies main gate pulses to the main gate lines GL1-*m* to GLn-m. The main gate driver 210 may include a shift register having stages SRC1 to SRCn, which are connected together in series. Output terminals of the stages SRC1 to SRCn may be connected to the main gate lines GL1-*m* to GLn-m, respectively. Main gate lines GL1-*m* to GLn-m may correspond in a one-to-one relationship with stages SRC1 to SRCn. Thus, the stages SRC1 to SRCn may sequentially apply main gate pulses to the corresponding main gate lines.

The second peripheral area PA2 may be arranged proximate to second ends of the main gate lines GL1-*m* to GLn-m. The second peripheral area PA2 may include a sub-gate driver 220, which is connected to the main gate lines GL1-*m* to GLn-m to receive the main gate pulses and then output the sub-gate pulses to the sub-gate lines GL1-*s* to GLn-s. The sub-gate driver 220 may include inverters INC1 to INCn, which may be connected to the sub-gate lines GL1-*s* to GLn-s. Sub-gate lines GL1-*s* to GLn-s may correspond in a one-to-one relationship with inverters INC1 to INCn. Thus, the inverters INC1 to INCn may apply sub-gate pulses to the corresponding sub-gate lines while being turned on.

The stages SRC1 to SRCn of the main gate driver 210 and the inverters INC1 to INCn of the sub-gate driver 220 will be described in more detail below with reference to FIG. 2, FIG. 3, FIG. 4, FIG. 5, and FIG. 6.

In the present exemplary embodiment of the present invention, the main gate driver 210 and the sub-gate driver 220 may be arranged on the array substrate 110 substantially simultaneously with the pixels through a manufacturing process such as a thin film forming process. In this manner, the main gate driver 210 and the sub-gate driver 220 may be integrated onto the array substrate 110, so that drive chips are not necessary. As a result, the size of the LCD apparatus 500 may be reduced.

The third peripheral area PA3 may be arranged adjacent to an end of the data lines DL1 to DLm, and a first end of a tape carrier package 300 may be connected to the third peripheral area PA3. A second end of the tape carrier package 300 may be connected to the printed circuit board 400. Data driving chips 310 may be arranged on the tape carrier package 300 to provide data signals to the data lines DL1 to DLm. Accordingly, the data driving chips 310 may provide the data signals to the data lines DL1 to DLm in response to control signals output from the printed circuit board 400.

A first gate control signal may be applied to the main gate driver 210 from the printed circuit board 400 through the tape carrier package 300. In addition, a second gate control signal may be applied to the sub-gate driver 220 from the printed circuit board 400 through the tape carrier package 300. Thus, the main gate driver 210 may provide main gate pulses to the main gate lines GL1-*m* to GLn-m in response to the first gate control signal. The sub-gate driver 220 may provide sub-gate pulses to the sub-gate lines GL1-*s* to GLn-s in response to the second gate control signal.

Figure 2:
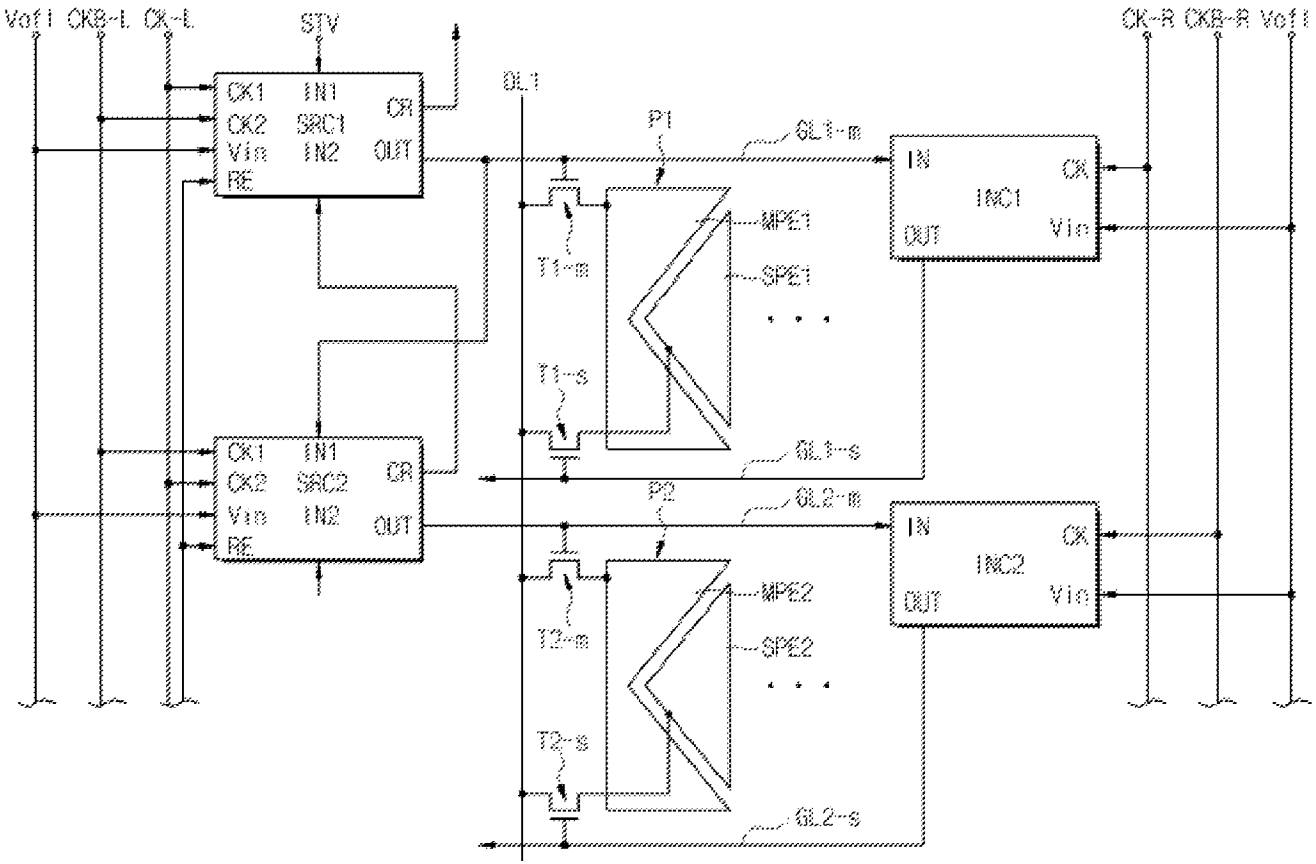
FIG. 2 shows a circuit diagram of an equivalent circuit for internal blocks of main gate drivers, sub-gate drivers, and pixels shown in FIG. 1.

FIG. 2 shows a circuit diagram of an equivalent circuit for internal blocks of main drivers, sub-gate drivers, and pixels shown in FIG. 1.

Referring to FIG. 2, a first pixel P1 may be connected to the first main gate line GL1-*m*, the first sub-gate line GL1-*s*, and the first data line DL1, and a second pixel P2 may be connected to the second main gate line GL2-*m*, the second sub-gate line GL2-*s*, and the first data line DL1.

The first pixel P1 may include a first main pixel and a first sub-pixel. The first main pixel may include a first main thin film transistor T1-*m* and a first main pixel electrode MPE1, and the first sub-pixel may include a first sub-thin film transistor T1-*s* and a first sub-pixel electrode SPE1.

The first main thin film transistor T1-*m* may be connected to the first main gate line GL1-*m* and the first data line DL1, and the first sub-thin film transistor T1-*s* may be connected to the first sub-gate line GL1-*s* and the first data line DL1. More specifically, a gate electrode of the first main thin film transistor T1-*m* may be connected to the first main gate line GL1-*m*, a source electrode of the first main thin film transistor T1-*m* may be connected to the first data line DL1, and a drain electrode of the first main thin film transistor T1-*m* may be connected to the first main pixel electrode MPE1. A gate electrode of the first sub-thin film transistor T1-*s* may be connected to the first sub-gate line GL1-*s*, a source electrode of the first sub-thin film transistor T1-*s* may be connected to the first data line DL1, and a drain electrode of the first sub-thin film transistor T1-*s* may be connected to the first sub-pixel electrode SPE1.

The second pixel P2 may include a second main pixel and a second sub-pixel. The second main pixel may include a second main thin film transistor T2-*m* and a second main pixel electrode MPE2, and the second sub-pixel may include a second sub-thin film transistor T2-*s* and a second sub-pixel electrode SPE2.

The second main thin film transistor T2-*m* may be connected to the second main gate line GL2-*m*, the first data line DL1 and the second main pixel electrode MPE2, and the second sub-thin film transistor T2-*s* may be connected to the second sub-gate line GL2-*s*, the first data line DL1 and the second sub-pixel electrode SPE2. More specifically, a gate electrode of the second main thin film transistor T2-*m* may be connected to the second main gate line GL2-*m*, a source electrode of the second main thin film transistor T2-*m* may be connected to the first data line DL1, and a drain electrode of the second main thin film transistor T2-*m* may be connected to the second main pixel electrode MPE2. A gate electrode of the second sub-thin film transistor T2-*s* may be connected to the second sub-gate line GL2-*s*, a source electrode of the second sub-thin film transistor T2-*s* may be connected to the first data line DL1, and a drain electrode of the second sub-thin film transistor T2-*s* may be connected to the second sub-pixel electrode SPE2.

A first stage SRC1 of the main gate driver 210 may be connected to the first main gate line GL1-*m* to apply a first main gate pulse to the first main gate line GL1-*m*.

Figure 5:
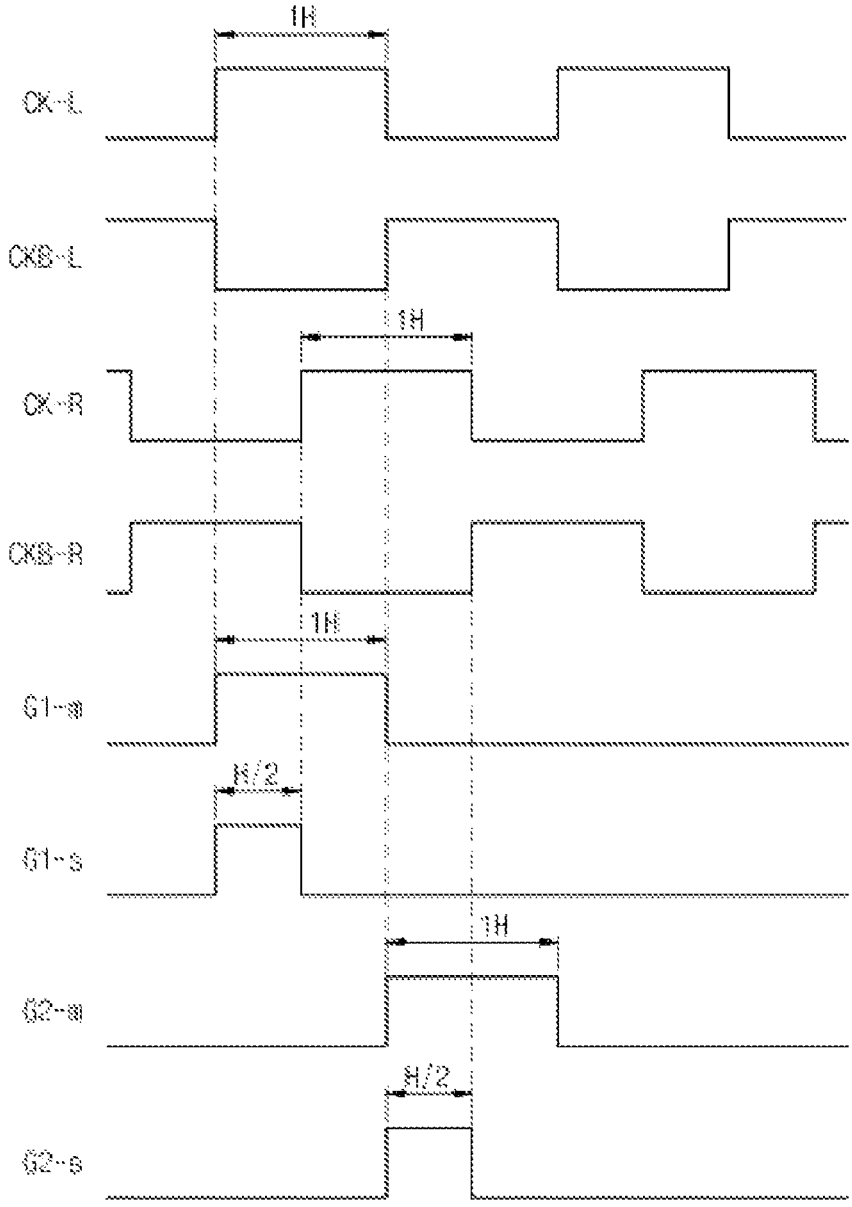
FIG. 5 shows a timing diagram for waveforms of a first clock, a second clock, a third clock, a fourth clock, a first main gate pulse, a second main gate pulse, a first sub-gate pulse, and a second sub-gate pulse shown in FIG. 2.

The first stage SRC1 may include first input terminal IN1 and second input terminal IN2, first clock terminal CK1 and second clock terminal CK2, an off voltage input terminal Vin, an output terminal OUT, a carry terminal CR, and a Reset Terminal RE. A start signal STV may be applied to the first input terminal IN1, first clock signal CK-L may be applied to the first clock terminal CK1, and second clock signal CKB-L may be applied to the second clock terminal CK2. As shown in FIG. 5 and described in more detail below, the second clock signal CKB-L may have inverted signal levels relative to the first clock signal CK-L.

A gate off voltage Voff may be applied to the off voltage input terminal Vin. In another exemplary embodiment of the present invention, a ground voltage may be applied to the off voltage input terminal Vin. Gate off voltage Voff may be selected based on a threshold voltage of the main thin film transistors T1-*m* to Tn-m in the main pixels, and may vary depending whether the thin film transistors are, for example, p-type thin film transistors or n-type thin film transistors.

The first main gate pulse may be output from output terminal OUT to first main gate line GL1-*m*, and a carry signal may be output from the carry terminal CR. In addition, a carry signal output from a second stage SRC2 may be applied to the second input terminal IN2.

The second stage SRC2 of the main gate driver 210 may be connected to the second main gate line GL2-*m* to apply a second main gate pulse to the second main gate line GL2-*m*.

The second stage SRC2 may have a structure identical to that of the first stage SRC1. First clock signal CK-L may be applied to the second clock terminal CK2, and second clock signal CKB-L may be applied to the first clock terminal CK1. This arrangement may be similar for additional stages in the main gate driver 210. Specifically, the first clock signal CK-L may be applied to first clock terminals CK1 of odd-numbered stages and second clock terminals CK2 of even-numbered stages of the main gate driver 210. In addition, the second clock signal CKB-L may be applied to second clock terminals CK2 of odd-numbered stages and first clock terminals CK1 of even-numbered stages of the main gate driver 210.

Although FIG. 2 shows only the first stage SRC1 and the second stage SRC2 of the main gate driver 210, subsequent stages SRC3 to SRCn may have structures identical to those of the first stage SRC1 and the second stage SRC2, so detailed description thereof will be omitted. A carry signal may be provided from the final stage SRCn to reset terminals RE of the stages to reset the stages.

The first inverter INC1 of the sub-gate driver 220 may be connected to the first main gate line GL1-*m* and to the first sub-gate line GL1-*s*, and may apply the first sub-gate pulse to the first sub-gate line GL1-*s* in response to receiving the first main gate pulse.

The first inverter INC1 may include an input terminal IN, a clock terminal CK, an off voltage input terminal Vin, and an output terminal OUT. The first main gate pulse may be received at the input terminal IN, and a third clock signal CK-R may be applied to the clock terminal CK. The gate off voltage Voff may be applied to the off voltage input terminal Vin and the first sub-gate pulse may be output from the output terminal OUT. Gate off voltage Voff may be the same as gate off voltage Voff applied to the first stage SRC1. Alternatively, gate off voltage Voff applied to the inverter INC1 to INCn may be selected based on a threshold voltage of sub-thin film transistors T1-*s* to Tn-s in the sub-pixels, and may vary depending whether the sub-thin film transistors are, for example, p-type thin film transistors or n-type thin film transistors.

The second inverter INC2 of the sub-gate driver 220 may be connected to the second main gate line GL2-*m* and may apply the second sub-gate pulse to the second sub-gate line GL2-*s* in response to receiving the second main gate pulse. The second inverter INC2 may include a structure substantially identical to that of the first inverter INC1. However, a fourth clock signal CKB-R may be applied to the clock terminal CK of the second inverter INC2. As shown in FIG. 5 and described in more detail below, the fourth clock signal CKB-R may have inverted signal levels relative to the third clock signal CK-R.

Figure 3:
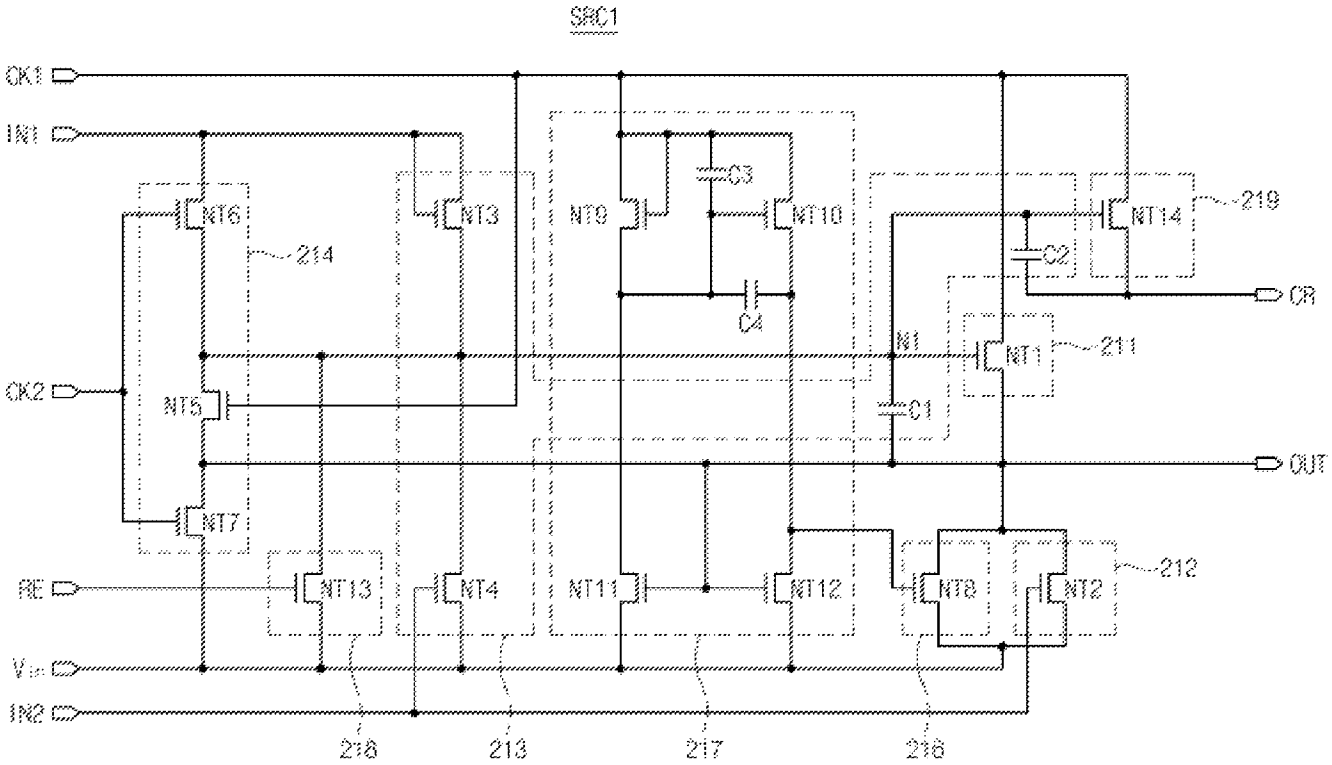
FIG. 3 shows an internal circuit diagram of a stage of a main gate driver shown in FIG. 2.

FIG. 3 shows an internal circuit diagram of a first stage SRC1 of the main gate driver shown in FIG. 2.

Referring to FIG. 3, the first stage SRC1 may include a pull-up section 211, a pull-down section 212, a pull-up driver 213, an anti-ripple section 214, a holding section 216, a switching section 217, a reset section 218, and a carry section 219.

The pull-up section 211 may include a pull-up transistor NT1 including a control electrode connected to the pull-up driver 213, an input electrode connected to the first clock terminal CK1, and an output electrode connected to the output terminal OUT. The first clock signal CK-L may be applied to the first clock terminal CK1. The pull-up transistor NT1 may output the first clock signal CK-L to the output terminal OUT in response to the control voltage provided from the pull-up driver 213. Accordingly, the first main gate pulse may be pulled up by the first clock signal CK-L having a high level during a 1H period, which will be described in more detail with respect to FIG. 5 below.

The carry section 219 may include a carry transistor NT14 including a control electrode connected to the pull-up driver 213, an input electrode connected to the first clock terminal CK1, and an output electrode connected to the carry terminal CR. The carry transistor NT14 may output the first clock signal CK-L to the carry terminal CR in response to the control voltage provided from the pull-up driver 213. Accordingly, the first carry signal may increase to a high level by the first clock signal CK-L during the 1H period.

The pull-down section 212 may include a pull-down transistor NT2 including a control electrode connected to the second input terminal IN2, an input electrode connected to the output terminal OUT, and an output electrode connected to the off voltage input terminal Vin. A carry signal from a subsequent stage, such as the second stage SRC2, may be applied to the second input terminal IN2, and the gate off voltage Voff may be applied to the off voltage input terminal Vin. The pull-down transistor NT2 may pull down the first main gate pulse, which has been pulled up by the first clock signal CK-L, in response to the second main gate pulse such that the first main gate pulse has a level corresponding to that of the gate off voltage Voff.

The pull-up driver 213 may include a buffer transistor NT3, a first capacitor C1, a second capacitor C2 and a discharge transistor NT4. The buffer transistor NT3 may include an input terminal and a control electrode, which are both connected to the first input terminal IN1, and an output electrode connected to the control electrode of the pull-up transistor NT1. A start signal STV may be applied to the first input terminal IN1 of the first stage SRC1. The first capacitor C1 may be arranged between the control electrode and the output electrode of the pull-up transistor NT1, and the second capacitor C2 may be arranged between the control electrode and the output electrode of the carry transistor NT14. The discharge transistor NT4 may include an input electrode connected to the output electrode of the buffer transistor NT3, a control electrode connected to the second input terminal IN2, and an output electrode connected to the off voltage input terminal Vin.

When the buffer transistor NT3 is turned on in response to the start signal STV, the first capacitor C1 and the second capacitor C2 may be charged. If the first capacitor C1 is charged with a voltage equal to or greater than the threshold voltage of the pull-up transistor NT1, the pull-up transistor NT1 may be turned on. Thus, the first clock signal CK-L may be output to the output terminal OUT by way of the pull-up transistor NT1, so that the first main gate pulse has a high level.

When the discharge transistor NT4 is turned on in response to a carry signal from a subsequent stage, a voltage stored in the first capacitor C1 may be discharged to the level of the gate off voltage Voff through the discharge transistor NT4. Accordingly, an electric potential of a first node N1 may be reduced to the level of the gate off voltage Voff, and the pull-up transistor NT1 may be turned off to reduce the first main gate pulse to a low level.

The anti-ripple section 214 may include first anti-ripple transistor NT5, second anti-ripple transistor NT6, and third anti-ripple transistor NT7. The first anti-ripple transistor NT5 may include a control electrode connected to the first clock terminal CK1, an input electrode connected to the output electrode of the pull-up transistor NT1, and an output electrode connected to the control electrode of the pull-up transistor NT1. The second anti-ripple transistor NT6 may include a control electrode connected to the second clock terminal CK2, an input electrode connected to the first input terminal IN1, and an output electrode connected to the control electrode of the pull-up transistor NT1. The third anti-ripple transistor NT7 may include a control electrode connected to the second clock terminal CK2, an input electrode connected to the output electrode of the pull-up transistor NT1, and an output electrode connected to the off voltage input terminal Vin. The second clock signal CKB-L may be applied to the second clock terminal CK2.

The first anti-ripple transistor NT5 may provide the first main gate pulse, which may be output from the output terminal OUT, to the control electrode of the pull-up transistor NT1 in response to the first clock signal CK-L applied to first clock terminal CK1. Thus, the electric potential of the first node N1 can be maintained at a level corresponding to the level of the gate off voltage Voff due to the first main gate pulse, to thereby prevent the ripple of the first node N1. The second anti-ripple transistor NT6 may provide the start signal STV applied to the first input terminal IN1 to the first node N1 in response to the second clock signal CKB-L applied to the second clock terminal CK2. Since the start signal STV is maintained in a low state, the electric potential of the first node N1 may be maintained at a low level so that the ripple of the first node N1 can be prevented. In addition, the third anti-ripple transistor NT7 may reduce a level of the first main gate pulse to a level corresponding to the gate off voltage Voff in response to the second clock signal CKB-L, thereby preventing the ripple of the first main gate pulse.

The holding section 216 may include a holding transistor NT8 including a control electrode connected to the output terminal of the main inverter 217, an input electrode connected to the output terminal OUT, and an output electrode connected to the off voltage input terminal Vin.

The main inverter 217 may include a first inverter transistor NT9, a second inverter transistor NT10, a third inverter transistor NT1 a fourth inverter transistor NT12, a third capacitor C3, and a fourth capacitor C4. The main inverter 217 may apply a signal to the control terminal of the holding transistor NT8 to turn the holding transistor NT8 on and off.

The first inverter transistor NT9 may include an input electrode and a control electrode, which are both connected to the first clock terminal CK1, and an output electrode connected to an output electrode of the second inverter transistor NT10 through the fourth capacitor C4. The second inverter transistor NT10 may include an input electrode connected to the first clock terminal CK1, a control electrode connected to the input electrode through the third capacitor C3, and an output electrode connected to the control electrode of the holding transistor NT8. The third inverter transistor NT11 may include an input electrode connected to the output electrode of the first inverter transistor NT9, a control electrode connected to the output terminal OUT, and an output electrode connected to the off voltage input terminal Vin. The fourth inverter transistor NT12 may include an input electrode connected to the control electrode of the holding transistor NT8, a control electrode connected to the output terminal OUT, and an output electrode connected to the off voltage input terminal Vin.

The third inverter transistor NT11 and the fourth inverter transistor NT12 may be turned on in response to the first main gate pulse during the 1H period where the first main gate pulse is at a high level. Thus, the first clock signal CK-L output from the first inverter transistor NT9 and the second inverter transistor NT10 may be discharged to a level corresponding to a level of the gate off voltage Voff through the third inverter transistor NT11 and the fourth inverter transistor NT12. Accordingly, during the 1H period, the output terminal of the main inverter 217 may output the gate off voltage Voff to the control terminal of the holding transistor NT8, and the holding transistor NT8 may be turned off.

After that, when the first main gate pulse has a low level, the third inverter transistor NT11 and the fourth inverter transistor NT12 may be turned off. As a result, the main inverter 217 may output the first clock signal CK-L from the first inverter transistor NT9 and the second inverter transistor NT10. Thus, when the first clock signal CK-L output from the main inverter 217 has a high level, the holding transistor NT8 discharges the first main gate pulse to a level corresponding to the level of the gate off voltage Voff.

Meanwhile, the reset section 218 may include a reset transistor NT13 including a control electrode connected to a reset terminal RE, an input electrode connected to the control electrode of the pull-up transistor NT1, and an output electrode connected to the off voltage input terminal Vin. The reset transistor NT13 may reduce the voltage of the first node N1 to a level corresponding to the level of the gate off voltage Voff in response to the final carry signal generated in the last stage SRCn, which may be input into the reset transistor NT13 through the reset terminal RE. Thus, the pull-up and carry transistors NT1 and NT14 may be turned off in response to the final carry signal of the last stage SRCn.

The final carry signal may be provided to reset terminals RE of the stages to turn off pull-up transistor NT1 and carry transistor NT14 of the stages, thereby resetting the stages.

Figure 4:
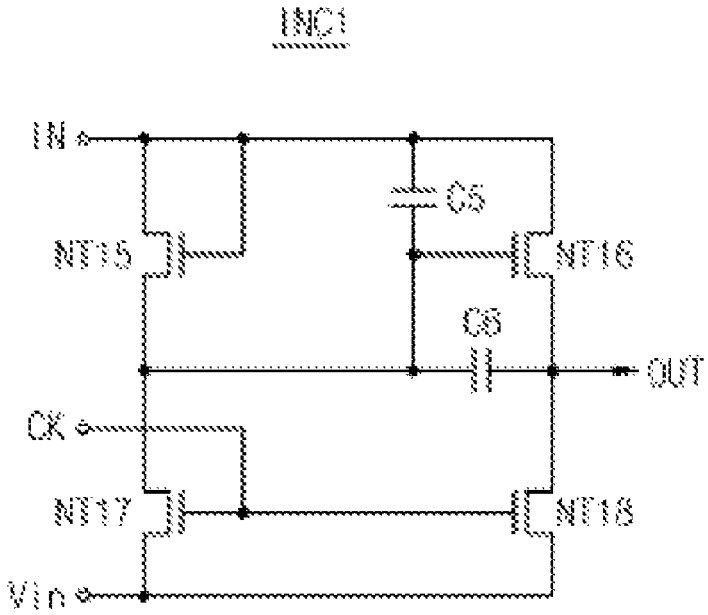
FIG. 4 shows an internal circuit diagram of an inverter of a sub-gate driver shown in FIG. 2.

FIG. 4 shows an internal circuit diagram of an inverter INC1 of the sub-gate driver shown in FIG. 2.

Referring to FIG. 4, the first inverter INC1 may include fifth inverter transistor NT15, sixth inverter transistor NT16, seventh inverter transistor NT17, eighth inverter transistor NT18, fifth capacitor C5, and sixth capacitor C6.

The fifth inverter transistor NT15 may include an input electrode and a control electrode, which are both connected to the input terminal IN, and an output electrode connected to a first electrode of the sixth capacitor C6. A second electrode of the sixth capacitor C6 may be connected to the output terminal OUT. The sixth inverter transistor NT16 may include an input electrode connected to the input terminal IN, a control electrode connected to the output electrode of the fifth inverter transistor NT15, and an output electrode connected to the output terminal OUT. The fifth capacitor C5 may be arranged between the input terminal IN and the control electrode of the sixth inverter transistor NT16. The seventh inverter transistor NT17 may include an input electrode connected to the output electrode of the fifth inverter transistor NT15, a control electrode connected to the clock terminal CK, and an output electrode connected to the off voltage input terminal Vin. The eighth inverter transistor NT18 may include an input electrode connected to the output terminal OUT, a control electrode connected to the clock terminal CK, and an output electrode connected to the off voltage input terminal Vin.

The fifth inverter transistor NT15 and the sixth inverter transistor NT16 may be turned on in response to the first main gate pulse being at a high level during the 1H period where the first main gate pulse, which is input to the input terminal IN, has a high level. Meanwhile, the seventh inverter transistor NT17 and the eighth inverter transistor NT18 may be off when third clock signal CK-R input to the clock terminal CK has a low level. At this time, the first main gate pulse, which passes through the fifth inverter transistor NT15 and the sixth inverter transistor NT16 during a first H/2 period that overlaps with the low period of the third clock signal CK-R, is output through the output terminal OUT. Thus, during the first H/2 period, the first main gate pulse may be output to the first sub-gate line GL1-*s* as a first sub-gate pulse.

Then, if a level of the third clock signal CK-R is shifted to a high level, the seventh inverter transistor NT17 and the eighth inverter transistor NT18 may be turned on. Thus, the first main gate pulse, which is output from the fifth inverter transistor NT15 and the sixth inverter transistor NT16 during a second H/2 period, may be discharged to a level corresponding to the level of the gate off voltage Voff when the seventh inverter transistor NT17 and the eighth inverter transistor NT18 turn on. Accordingly, during the second H/2 period when the third clock signal CK-R is at a high level, the output terminal OUT may output the first sub-gate pulse at a level corresponding to the level of the gate off voltage Voff.

Tn this manner, since one pixel includes a main pixel and a sub-pixel in the S-PVA LCD apparatus 500, the main pixel and the sub-pixel may be turned on during the 1H period to drive one pixel row including the main pixel and the sub-pixel.

Each subsequent inverter INC2 to INCn of the sub-gate driver 220 may have a structure substantially identical to that of the main inverter INC1 included in sub-gate driver 220. Accordingly, the sub-gate driver 220 can be operated with fewer transistors as compared with the main gate driver 210. As a result, the size of the sub-gate driver 220 can be smaller than the size of the main gate driver 210, and the manufacturing process of the S-PVA LCD apparatus 500 can be simplified.

Now, the 1H period and the H/2 period will be explained in more detail. According to illustrated embodiments of the present invention, the main gate driver 210 may sequentially generate the main gate pulse to have a high level signal during a time period of 1H, which may include a period equal to one-half of the period of the main gate pulse. The sub-gate driver 220 may generate the sub-gate pulse during the first H/2 period of 1H. The first period H/2 may be one-quarter of the period of the main gate pulse period and one-half of the 1H period. The sub-gate driver 220 may include a plurality of inverters INC1 to INCn, in which each inverter receives a main gate pulse and a third clock signal CK-R or a fourth clock signal CKB-R, each of which is delayed by an H/2 period as compared with the first clock signal CK-L or second clock signal CKB-L applied to the main gate driver 210, to generate a sub-gate pulse.

Tn addition, the first clock signal CK-L, the second clock signal CKB-L, the third clock signal CK-R, and the fourth clock signal CKB-R have the same frequency and a period set corresponding to the 2H period equal to the period of the main gate pulse. Therefore, the driving frequency of the main gate driver 210 and the sub-gate driver 220 may remain constant, thereby reducing power consumption of the S-PVA LCD apparatus 500.

FIG. 5 shows a timing diagram for waveforms of a first clock, a second clock, a third clock, a fourth clock, a first main gate pulse, a second main gate pulse, a first sub-gate pulse, and a second sub-gate pulse shown in FIG. 2.

Referring to FIG. 5, the first clock signal CK-L has a high level during the 1H period where a first main thin film transistor is turned on. In addition, since the first clock signal CK-L has a signal with an inverted level with respect to the second clock signal CKB-L, the second clock signal CKB-L has a phase shift of 1H period relative to the first clock signal CK-L. Further, since the third clock signal CK-R has a signal with an inverted level with respect to the fourth clock signal CKB-R, the fourth clock signal CKB-R has a phase shift of 1H period relative to the third clock signal CK-R. In addition, the third clock signal CK-R has a phase shift of H/2 period relative to the first clock signal CK-L, and the fourth clock signal CKB-R has a phase shift of H/2 period relative to the second clock signal CKB-L.

During the 1H period, the first stage SRC1 outputs the first main gate pulse G1-*m* having a high level corresponding to the high level of the first clock signal CK-L. The first inverter INC1 outputs the first sub-gate pulse G1-*s* in response to receiving the first main gate pulse G1-*m* and the third clock signal CK-R during the first H/2 period of 1H period. Accordingly, the first main gate pulse G1-*m* and the first sub-gate pulse G1-*s* have a high level during the first H/2 period of 1H period, and are applied to the first main gate line GL1-*m* and the first sub-gate line GL1-*s*, respectively.

After the first H/2 period of 1H period, the first sub-gate pulse G1-*s* output from the first inverter INC1 is discharged to a low level corresponding to the level of the gate off voltage Voff. Thus, only the first main gate pulse G1-*m* has a high level during the second H/2 period of 1H period.

During the next 1H period, the second stage SRC2 outputs the second main gate pulse G2-*m* corresponding to the high period of the second clock signal CKB-L. The second inverter INC2 outputs the second sub-gate pulse G2-*s* in response to receiving the second main gate pulse G2-*m* and the fourth clock signal CKB-R during the first H/2 period of the next 1H period. Accordingly, the second main gate pulse G2-*m* and the second sub-gate pulse G2-*s* have a high level during the first H/2 period of the next 1H period and are applied to the second main gate line GL2-*m* and the second sub-gate line GL2-*s*, respectively.

After that, the second sub-gate pulse G2-*s* output from the second inverter INC2 is discharged to a low level corresponding to the level of the gate off voltage Voff. Thus, only the second main gate pulse G2-*m* has a high level during the second H/2 period of the next 1H period.

Figure 6:
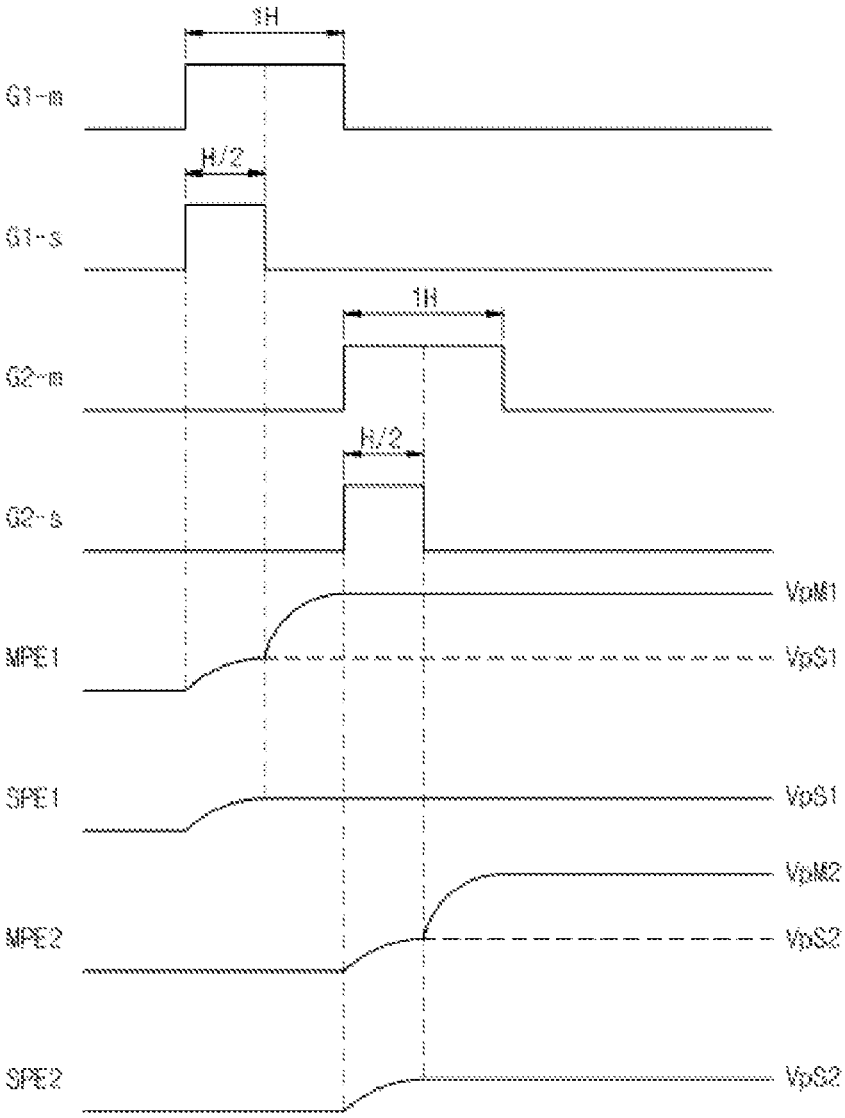
FIG. 6 shows a timing diagram for waveforms of a first main pixel voltage, a second main pixel voltage, a first sub-pixel voltage, and a second sub-pixel voltage corresponding to a first main gate pulse, a second main gate pulse, a first sub-gate pulse, and a second sub-gate pulse.

FIG. 6 shows a timing diagram for waveforms of a first main pixel voltage, a second main pixel voltage, a first sub-pixel voltage, and a second sub-pixel voltage corresponding to a first main gate pulse G1-*m*, a second main gate pulse G2-*m*, a first sub-gate pulse G1-*s*, and a second sub-gate pulse G2-*s*.

Referring to FIG. 2, FIG. 3, FIG. 4, FIG. 5, and FIG. 6, the first main thin film transistor T1-*m* is turned on in response to the first main gate pulse G1-*m* being at a high level during the 1H period, and the first sub-thin film transistor T1-*s* is turned on in response to the first sub-gate pulse G1-*s* being at a high level during the first H/2 period of the 1H period.

A first sub-pixel voltage VpS1 may be applied to the first data line DL1 during the first H/2 period of the 1H period. The first sub-pixel voltage VpS1 may be applied to the first main pixel electrode MPE1 through the first main thin film transistor T1-*m* when turned on and to the first sub-pixel electrode SPE1 through the first sub-thin film transistor T1-*s* when turned on.

Although the first main thin film transistor T1-*m* is turned on when the first main gate pulse G1-*m* is at a high level during the second H/2 period of the 1H period, the first sub-thin film transistor T1-*s* turns off when first sub-gate pulse G1-*s* shifts to a low level. In addition, a first main pixel voltage VpM1 may be applied to the first data line DL1 during the second H/2 period of the 1H period. Accordingly, the first main pixel voltage VpM1 may be applied to only the first main pixel electrode MPE1 through the first main thin film transistor T1-*m* when turned on.

Since the first main pixel electrode MPE1 may be charged with the first sub-pixel voltage VpS1 during the first H/2 period of the 1H period, the first main pixel electrode MPE1 can be charged with the first main pixel voltage VpM1 within a shorter time during the second H/2 period of the 1H period. Accordingly, the S-PVA LCD apparatus 500 having the above structure can improve the response speed of liquid crystals corresponding to the main pixel.

Meanwhile, the second main thin film transistor T2-*m* may be turned on in response to the second main gate pulse G2-*m* being at a high level during the next 1H period, and the second sub-thin film transistor T2-*s* may be turned on in response to the second sub-gate pulse G2-*s* being at a high level during the first H/2 period in the next 1H period.

A second sub-pixel voltage VpS2 may be applied to the first data line DL1 during the first H/2 period in the next 1H period. The second sub-pixel voltage VpS2 may be applied to the second main pixel electrode MPE2 through the second main thin film transistor T2-*m* when turned on and to the second sub-pixel electrode SPE2 through the second sub-thin film transistor T2-*s* when turned on.

Although the second main thin film transistor T2-*m* is turned on when the second main gate pulse G2-*m* is at a high level during the second H/2 period in the next 1H period, the second sub-thin film transistor T2-*s* turns off when the second sub-gate pulse G2-*s* shifts to a low level. In addition, a second main pixel voltage VpM2 may be applied to only the first data line DL1 during the second H/2 period of the next H1 period. Accordingly, the second main pixel voltage VpM2 may be applied to only the second main pixel electrode MPE2 through the second main thin film transistor T2-*m* when turned on.

Since the second main pixel electrode MPE2 may be charged with the second sub-pixel voltage VpS2 during the first H/2 period of the next 1H period, the second main pixel electrode MPE2 can be charged with the second main pixel voltage VpM2 within a shorter time during the second H/2 period of the next 1H period. Accordingly, the S-PVA LCD apparatus 500 having the above structure can improve the response speed of liquid crystals corresponding to the main pixel.

According to the LCD apparatus having the above structure, the sub-gate driver may include a plurality of inverters, which receive a main gate pulse and a clock signal delayed from the clock signal applied to the main gate driver by the H/2 period, to output the sub-gate pulses.

Therefore, the sub-gate driver can be operated by using a smaller number of transistors as compared with the main gate driver. As a result, the size of the sub-gate driver can be reduced. In addition, the driving frequency of the main gate driver and the sub-gate driver is maintained at a constant frequency, thereby reducing power consumption of the LCD apparatus.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A display apparatus, comprising:

a first substrate comprising a main gate line, a sub-gate line, a data line, and a pixel, the pixel comprising a main pixel connected to the main gate line and the data line and a sub-pixel connected to the sub-gate line and the data line;

a second substrate coupled with the first substrate and facing the first substrate;

a main gate driver to apply a first main gate pulse to the main gate line for a first period, the main gate line being connected to a gate of a main thin film transistor of the main pixel to supply the first main gate pulse to the gate;

a sub-gate driver to apply a sub-gate pulse to the sub-gate line during a second period, wherein the second period comprises a portion of the first period; and a data driver to apply a sub-pixel voltage to the data line during the second period, and to apply a main pixel voltage to the data line during a third period comprising a portion of the first period that is separate from the second period.

2. The display apparatus of claim 1, wherein the main gate driver comprises a shift register having a first stage and a second stage connected in series, the first stage to apply the first main gate pulse to the main gate line during the first period.

3. The display apparatus of claim 2, wherein the main gate driver is directly arranged on the first substrate through a thin film forming process.

4. The display apparatus of claim 2, wherein the first stage is configured to receive a first clock signal having a high level during a period corresponding to the first period to output the first main gate pulse in response to the first clock signal having a high level, and the second stage is configured to receive a second clock signal having an inverted level relative to the first clock signal to output a second main gate pulse in response to the second clock signal having a high level.

5. The display apparatus of claim 4, wherein the sub-gate driver comprises a first inverter to receive the first main gate pulse and to apply the sub-gate pulse to the sub-gate line during the second period.

6. The display apparatus of claim 5, wherein the first stage comprises a switching section having a structure substantially similar to a structure of the inverter.

7. The display apparatus of claim 5, wherein the sub-gate driver is directly arranged on the first substrate through a thin film forming process.

8. The display apparatus of claim 5, wherein the first inverter is configured to receive a third clock signal having a low level during a period corresponding to the second period so as to output an odd-numbered sub-gate pulse in response to the third clock signal having a low level.

9. The display apparatus of claim 8, wherein the sub-gate driver further comprises:

a second inverter to receive a fourth clock signal having an inverted level relative to the third clock signal so as to output an even-numbered sub-gate pulse in response to the fourth clock signal having a low level.

10. The display apparatus of claim 8, wherein the first inverter comprises:

a sub-pull up section to output the first main gate pulse to an output terminal during the second period; and a discharge section to discharge the first main gate pulse being output to the output terminal to a level corresponding to a level of a gate off voltage during the third period.

11. The display apparatus of claim 10, wherein the first inverter further comprises:

an input terminal to receive the first main gate pulse;

a clock terminal to receive the third clock signal; and a voltage input terminal to receive the gate off voltage.

12. The display apparatus of claim 9, wherein the fourth clock signal is applied to a clock terminal of the second inverter.

13. The display apparatus of claim 12, wherein the third clock signal is delayed relative to the first clock signal by a time equal to the second period, and the fourth clock signal is delayed relative to the second clock signal by a time equal to the third period.

14. The display apparatus of claim 1, wherein the main pixel comprises:

the main thin film transistor connected to the main gate line and the data line to output the main pixel voltage in response to the first main gate pulse; and a main pixel electrode connected to an output electrode of the main thin film transistor to receive the main pixel voltage, and wherein the sub-pixel comprises:

a sub-thin film transistor connected to the sub-gate line and the data line to output the sub-pixel voltage in response to the sub-gate pulse; and a sub-pixel electrode connected to an output electrode of the sub-thin film transistor to receive the sub-pixel voltage.

15. The display apparatus of claim 14, wherein the main pixel voltage has a level higher than a level of the sub-pixel voltage.

16. The display apparatus of claim 15, wherein, during the second period, the sub-thin film transistor applies the sub-pixel voltage to the sub-pixel electrode in response to the sub-gate pulse, and the main thin film transistor charges the main pixel electrode with the sub-pixel voltage in response to the first main gate pulse.

17. The display apparatus of claim 16, wherein, during the third period, the main thin film transistor applies the main pixel voltage to the main pixel electrode, and the sub-thin film transistor is turned off in response to the sub-gate pulse.

18. A liquid crystal display (LCD) apparatus, comprising:

a first substrate;

a second substrate facing the first substrate;

a pixel having a main pixel and a sub-pixel;

a main gate driver to output a main gate pulse to the main pixel, the main gate driver being connected to a gate of a main thin film transistor in the main pixel to supply the main gate pulse to the gate for a first period;

a sub-gate driver to output a sub-gate pulse to the sub-pixel in response to the main gate pulse during a second period comprising a portion of the first period, the sub-gate driver being connected to the main gate driver to receive the main gate pulse; and a data driver to apply a sub-pixel voltage to a data line during the second period, and to apply a main pixel voltage to the data line during a third period comprising a portion of the first period that is separate from the second period, the data line being connected to a source of the main thin film transistor.

19. The LCD apparatus of claim 18, further comprising:

a data driver connected to the main pixel and the sub-pixel, the data driver to output a first data signal to the main pixel and the sub-pixel during a first period, and to output a second data signal to the main pixel during a second period.

20. The LCD apparatus of claim 19, further comprising:

a sub-pixel thin film transistor having a gate electrode connected to the sub-gate driver, a source electrode connected to the data driver, and a drain electrode connected to a sub-pixel electrode, wherein the sub-pixel thin film transistor is turned off during the second period.

21. A method of driving a display apparatus comprising a main gate line, a sub-gate line, and a data line connected to a pixel, the method comprising:

applying a main gate pulse to a main gate line during a first period, the main gate line connected to a gate of a main thin film transistor in the pixel to supply the main gate pulse to the gate;

applying a sub-gate pulse to a sub-gate line during a second period, wherein the second period comprises a portion of the first period;

applying a sub-pixel voltage to a data line during the second period, and applying a main pixel voltage to the data line during a third period comprising a portion of the first period that is separate from the second period; and displaying a sub-image using the sub-pixel voltage in response to the sub-gate pulse during the second period, and displaying a main-image using the main-pixel voltage in response to the main-gate pulse during the third period.

* * * * *